US005877141A

United States Patent [19]

Gabriel et al.

[11] Patent Number: 5,877,141

[45] Date of Patent: Mar. 2, 1999

[54] STABILIZATION OF ENZYMES IN LAUNDRY DETERGENT COMPOSITIONS

[75] Inventors: Gladys Saliba Gabriel, Cranbury; Ronald B. Bell, Plainsboro, both of N.J.

[73] Assignee: Rhodia Inc., Cranbury, N.J.

[21] Appl. No.: 794,139

[22] Filed: Feb. 3, 1997

Related U.S. Application Data

[63] Continuation of Ser. No. 502,710, Jul. 14, 1995, abandoned.

[51] Int. Cl.[6] ..... C11D 3/386; C11D 3/17

[52] U.S. Cl. ..... 510/392; 510/393; 510/306; 510/309; 510/330; 510/320; 510/321; 510/348; 510/488; 8/137

[58] Field of Search ..... 510/392, 393, 510/306, 309, 530, 320, 321, 348, 488; 8/137

[56] References Cited

U.S. PATENT DOCUMENTS

| | | | |
|---|---|---|---|
| 3,819,528 | 6/1974 | Berry | 252/153 |
| 4,142,999 | 3/1979 | Bloching et al. | 252/544 |
| 4,238,345 | 12/1980 | Guilbert et al. | 252/174.12 |
| 4,243,543 | 1/1981 | Guilbert et al. | 252/105 |
| 4,548,727 | 10/1985 | Shaer | 252/171 |
| 4,582,636 | 4/1986 | Crossin | 252/546 |
| 4,900,475 | 2/1990 | Ramachandran | 252/532 |
| 5,071,586 | 12/1991 | Kaiserman et al. | 252/174.17 |
| 5,221,495 | 6/1993 | Cao | 252/135 |
| 5,275,753 | 1/1994 | de Buzzaccarini | 252/95 |
| 5,458,809 | 10/1995 | Fredj et al. | 252/542 |
| 5,458,810 | 10/1995 | Fredj et al. | 252/542 |

FOREIGN PATENT DOCUMENTS

| | | |
|---|---|---|
| 2181125 | 7/1996 | Canada . |
| 0028866 | 5/1981 | European Pat. Off. . |

*Primary Examiner*—Kery A. Fries

*Attorney, Agent, or Firm*—John Daniel Wood; Craig M. Bell

[57] ABSTRACT

Glycolic acid or its salts is effective in stabilizing enzymes in liquid laundry detergent compositions.

28 Claims, No Drawings

STABILIZATION OF ENZYMES IN LAUNDRY DETERGENT COMPOSITIONS

This is a continuation of application Ser. No. 08/502,710, filed Jul. 14, 1995, now abandoned.

BACKGROUND OF THE INVENTION

1. Field of Invention

This invention relates to the long term stabilization of enzymes contained in liquid laundry detergent compositions.

2. Prior Art

The desirability of using enzymes in cleaning compositions is well known. For example, lipase enzymes are useful in their ability to reduce macro molecules such as fat into components that can be easily washed away with detergents and/or water. Protease enzymes, for example, are useful for their ability to reduce proteinaceous stains which can then also be readily washed away.

The stability of enzymes in current heavy duty liquid laundry detergent compositions (HDLs) is generally poor. The surfactants found in the detergent compositions can induce denaturation of the enzyme and, when a protease is present, the protease will cause proteolytic digestion of the other enzymes (if not a protease) or of itself in a process called autolyses.

Proteins taught in U.S. Pat. No. 4,842,767, such as casein, are known to improve enzyme stability in HDLs. Other approaches used for stabilization of enzymes in HDLs include the use of low molecular weight carboxylic acids (preferably formate) and calcium such as disclosed in U.S. Pat. Nos. 4,305,837, 4,318,818, and 4,490,285; and the use of boron containing compounds in combination with a short chain carboxylic acid and calcium as shown in U.S. Pat. No. 4,537,707. U.S. Pat. No. 4,842,758 teaches an enzyme stabilizing system of a boron compound, a protein such as casein and a $C_3$–$C_8$ organic alpha-hydroxy carboxylic or polycarboxylic acid.

SUMMARY OF THE INVENTION

It is now been found the use of glycolic acid or its salts alone or in combination with other additives provides significantly improved enzyme stability in HDLs formulations.

In particular, the present invention provides a heavy duty liquid detergent composition containing a stabilized enzyme which comprises:

1) at least one of anionic, nonionic, cationic, amphoteric or zwitterionic surfactant or a mixture thereof in an amount of from about 5 to about 85% surfactant actives weight based on the total weight of the detergent composition;
2) an effective amount of an enzyme; and
3) an effective amount of an enzyme stabilizing system comprising glycolic acid or a salt thereof alone or in combination with a lower molecular weight carboxylic acid and/or calcium salt in an amount sufficient to stabilize the enzyme from substantial loss of activity.

DETAILED DESCRIPTION OF THE INVENTION

The present invention relates to HDL formulations containing an effective amount of enzymes and further containing an effective amount of a glycolic acid (and salts thereof) stabilizing system for the enzymes in the formulation. In addition, the stabilizer system can include lower molecular weight carboxylic acids and/or calcium ion.

The heavy duty liquid laundry detergent compositions comprise one or more of an anionic, nonionic, cationic, amphoteric or zwitterionic surfactants.

Anionic Surfactants

Anionic surfactant detergents which may be used in the invention are those surfactant compounds which contain a long chain hydrocarbon hydrophobic group in their molecular structure and a hydrophilic group, i.e., water solubilizing group including salts such as carboxylate, sulfonate, sulfate or phosphate groups. The salts may be sodium, potassium, calcium, magnesium, barium, iron, ammonium and amine salts of such surfactants.

Anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group. Examples of such anionic surfactants include water soluble salts of alkyl benzene sulfonates having between 8 and 22 carbon atoms in the alkyl group, alkyl ether sulfates having between 8 and 22 carbon atoms in the alkyl group.

Particularly preferred are linear sodium and potassium alkyl ether sulfates that are synthesized by sulfating a higher alcohol having between 8 and 18 carbon atoms and having 2 to 9 moles of ethylene oxide. Another preferred anionic surfactant is alkyl benzene sulfonate, in which the alkyl group contains between 9 and about 15, preferably between about 11 to about 13 carbon atoms in a straight chain or branched chain configuration, and most preferred a linear straight chain having an average alkyl group of about 11 carbon atoms.

In particularly preferred embodiments, mixtures of anionic surfactants are utilized, with mixtures of alkyl or alkylaryl sulfonate and alkyl and/or alkyl ether sulfate surfactants being especially preferred. Such embodiments comprise a mixture of alkali metal salts, preferably sodium salts, of alkyl benzene sulfonates having from about 9 to about 15, and more preferably from 11 to 13 carbon atoms with an alkali metal salt, preferably sodium, of an alkyl sulfate or alkyl ethoxysulfate having 10 to 20, and preferably 12 to 18 carbon atoms with an average ethoxylation of 2 to 4.

Specific anionic surfactants which may be selected include linear alkyl benzene sulfonates such as dodecylbenzene sulfonate, decylbenzene sulfonate, undecylbenzene sulfonate, tridecylbenzene sulfonate, nonylbenzene sulfate and the sodium, potassium, ammonium, triethanol ammonium and isopropyl ammonium salts thereof. Particularly preferred sulfonate salt is sodium dodecylbenzene sulfonate. Such chemicals have been sold under the trade name Biosoft B100 by Stepan Chemicals of Northfield, Ill. Other anionic surfactants include polyethoxylated alcohol sulfates, such as those sold under the trade name Neodol 25-3S by Shell Chemical Company. Examples of other anionic surfactants are provided in U.S. Pat. No. 3,976,586. To the extent necessary, this patent is expressly incorporated herein by reference.

The anionic surfactant is generally used in amount ranging from about 1% to about 50%, preferably between about 5% and about 40% and more preferably from about 10% to about 25% by weight of surfactant actives based on the total surfactant actives weight in the detergent composition.

Nonionic Surfactants

The surfactant component of the composition of the invention can include one or more nonionic surfactants. The nonionic surfactant(s) is not critical and may be any of the known nonionic surfactants which are generally selected on the basis of compatibility, effectiveness and economy.

Examples of useful nonionic surfactants include condensates of ethylene oxide with a hydrophobic moiety which has an average hydrophilic lipolytic balance (HLB) between about 8 to about 16, and preferably between about 10 and about 12.5. The surfactants include the condensation products of primary or secondary aliphatic alcohols having from about 8 to about 24 carbon atoms, in either straight or branch chain configuration, with from about 2 to about 40, and preferably between about 2 and about 9 moles of ethylene oxide per mole of alcohol.

In a preferred embodiment, the aliphatic alcohol comprises between about 9 and about 18 carbon atoms and is ethoxylated with between about 3 and about 9 moles of ethylene oxide per mole of aliphatic alcohol. Especially preferred are the about 12 to about 15 carbon chain length primary alcohol ethoxylates containing from about 5 to about 9 moles of ethylene oxide per mole of alcohol. One such material is commercially sold under the trade name Neodol 25-9 by Shell Chemical Company. Other commercially available nonionic surfactants include Neodol 25-6.5 and Neodol 25-7.

Other suitable nonionic surfactants include the condensation products of from about 6 to about 12 carbon atoms alkyl phenols with about 3 to about 30, and preferably between about 5 to about 14 moles of ethylene oxide. Examples of such surfactants are sold under the trade names Igepal CO 530, Igepal CO 630, Igepal CO 720 and Igepal CO 730 by Rhône-Poulenc Inc. Still other suitable nonionic surfactants are described in U.S. Pat. No. 3,976,586 which, to the extent necessary, is expressly incorporated herein by reference.

The composition of the present invention generally contains the nonionic surfactant in an amount ranging from about 1% to about 75%, preferably between about 6% and about 50%, and more preferably between about 15% and about 35% by weight of surfactant actives based on the total surfactant actives weight in the detergent composition.

Cationic Surfactants

Many cationic surfactants are known in the art and almost any cationic surfactant having at least one long chain alkyl group of about 10 to 24 carbon atoms is suitable for use in the present invention. Such compounds are described in "Cationic Surfactants", Jungermann, 1970, incorporated herein by reference.

Specific cationic surfactants which can be used as surfactants in the invention are described in U.S. Pat. No. 4,497,718, incorporated herein by reference.

As with the nonionic and anionic surfactants, the compositions the invention may use cationic surfactants alone but preferably in combination with other surfactants as is known in the art. The composition of the invention can contain any useful amount but preferably up to about 20% by weight of surfactant actives based on the total surfactant actives weight in the detergent composition. Of course, the composition may contain no cationic surfactants at all.

Amphoteric/Zwitterionic Surfactants.

Amphoteric surfactants can broadly be described as derivatives of aliphatic or aliphatic derivatives of heterocyclic secondary and tertiary amines in which the aliphatic radical may be straight or branched and wherein one of the aliphatic substituents contains from about 8 to about 18 carbon atoms and at least one contains an anionic water-solubilizing group, e.g., carboxy, sulfonate, sulfate.

Zwitterionic surfactants can be broadly described as derivatives of secondary and tertiary amines, derivatives of heterocyclic secondary and tertiary amines or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least aliphatic substituent containing an anionic water-solubilizing group, e.g., carboxy, sulfonate, sulfate, phosphate or phosphonate.

Examples of suitable amphoteric surfactants include the alkali metal, alkaline earth metal, ammonium or substituted ammonium salts of alkyl amphocarboxyglycinates and alkyl amphocarboxypropionates, alkyl amphodipropionates, alkyl monoacetate, alkyl diacetates, alkyl amphoglycinates, and alkyl amphopropionates wherein alkyl represents an alkyl group having from 6 to about 20 carbon atoms. Other suitable surfactants include alkyliminopropionates, alkyliminidipropionates, and alkylamphopropylsulfonates having between 12 and 18 carbon atoms, alkyl betaines and amidopropylbetaines and alkyl sultaines and alkylamidopropylhydroxy sultaines wherein alkyl represents an alkyl group having from about 6 to about 20 carbon atoms.

Particularly useful amphoteric surfactants include both mono and dicarboxylates such as those of the formulae:

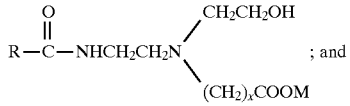

; and (I)

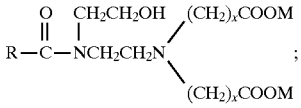

; (II)

wherein R is an alkyl group of 6–20 carbon atoms, x is 1 or 2 and M is hydrogen or sodium. Mixtures of the above structures are particularly preferred.

Other amphoteric surfactants can be illustrated by the following formulae:

Alkyl betaines (III)

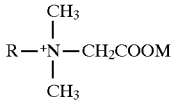

Amidopropyl betaines (IV)

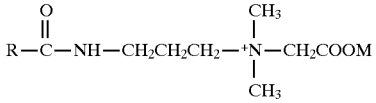

Alkyl sultaines (V)

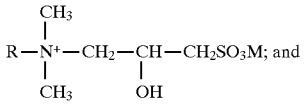

-continued

Alkyl amidopropylhydroxy sultaines (VI)

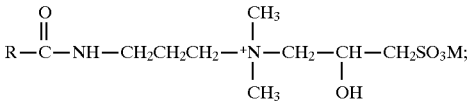

wherein R is an alkyl group of 6–20 carbon atoms and M is hydrogen or sodium.

Of the above amphoteric surfactants, particularly preferred are the alkali salts of alkyl amphocarboxyglycinates and alkyl amphocarboxypropionates, alkyl amphodipropionates, alkyl amphodiacetates, alkyl amphoglycinates, alkyl amphopropyl sulfonates and alkyl amphopropionates wherein alkyl represents an alkyl group having 6 to 20 carbon atoms. Even more preferred are compounds wherein the alkyl group is derived from natural sources such as coconut oil or is a lauryl group. In reciting a carbon chain length range, it is intended to include compounds such as cocoamphodipropionate. Such coco groups are naturally derived materials which have various specific chain lengths or an average chain length within the range.

Commercially useful and preferred amphoteric surfactants include (as sodium salts):

cocoamphoacetate (sold under the trademarks MIRANOL® CM CONC. and MIRAPON® FA), cocoamphodiacetate (sold under the trademarks MIRANOL® C2M CONC. and MIRAPON® FB), cocoamphopropionate (sold under the trademarks MIRANOL® CM-SF CONC. and MIRAPON® FAS), cocoamphodipropionate (sold under the trademarks MIRANOL® C2M-SF and MIRANOL® FBS), lauroamphoacetate (sold under the trademarks MIRANOL® HM CONC. and MIRAPON® LA), lauroamphodiacetate (sold under the trademarks MIRANOL® H2M CONC. and MIRAPON® LB), lauroamphodipropionate (sold under the trademarks MIRANOL® H2M-SF CONC. AND MIRAPON® LBS), lauroamphodiacetate obtained from a mixture of lauric and myristic acids (sold under the trademark MIRANOL® BM CONC.), and cocoamphopropyl sulfonate (sold under the trademark MIRANOL® CS CONC.).

Somewhat less preferred are:

caproamphodiacetate (sold under the trademark MIRANOL® S2M CONC.), caproamphoacetate (sold under the trademark MIRANOL® SM CONC.), caproamphodipropionate (sold under the trademark MIRANOL® S2M-SF CONC.), and stearoamphoacetate (sold under the trademark MIRANOL® DM).

The amphoteric surfactant generally comprises between about 1% and about 35%, preferably between about 5% and about 30% and more preferably from about 10% to about 25% by weight of surfactant actives based on the total surfactant actives weight in the detergent composition.

Enzymes

Enzymes for inclusion in the liquid detergent compositions of the invention are those suitable for use in detergents as is well known in the prior art. The preferred enzymes are protease or proteolytic enzymes. The proteolytic enzyme used in the invention can be of vegetable, animal or microorganism origin. Preferably, it is of the latter origin, which includes yeast, fungi, molds and bacteria. Particularly preferred are bacterial subtilisin type proteases, obtained from e.g., particular strains of B. subtilis and B. lichniformis. Examples of suitable commercially available proteases are Alcalase, Savinase, Esperase, all of NOVO Industri a/S; Maxatase and Maxacal of Gist-Brocades; Kazusase of Showa Denko; BPN and BPN' proteases and the like. Mixtures of different proteolytic enzymes may be used.

While various specific enzymes have been described above, it is to be understood that any protease which can confer the desired proteolytic activity to the composition may be used and the invention is not limited in any way by specific choice of proteolytic enzyme.

In addition to proteases, it is to be understood that other enzymes such as lipases, cellulases, oxidases, amylases and the like which are well known in the art may also be used with the composition of the invention either alone or in combination with other enzymes. The enzymes useful herein are preferably purified, prior to incorporation in the finished composition, as is usual in the industry so that they have no detectable odor.

On a weight percentage basis of the active ingredients in the composition, it is preferable that the enzyme composition range from about 0.01% to about 5% by weight based on the total surfactant actives weight in the detergent composition. These amounts are based on the enzyme activity corrected to 100%.

Glycolic Acid

It has been surprisingly found that enzymes in a detergent composition can be stabilized with an enzyme stabilizing system comprising glycolic acid. Glycolic acid is a powder in pure form and is preferably used in an aqueous solution, such as the industrially supplied 70% solution. The glycolic acid can also be used in the form of its salts that can be illustrated by the alkali metal salts, e.g., sodium and potassium, as well as the ammonium and alkanolamine salts such as monoethanolamine and triethanolamine (which it is believed form alkanolammonium salts) salts, and the like and mixtures thereof. The preferred salt is the sodium salt.

The glycolic acid or its salts can be used in amounts sufficient to effect enzyme stabilization. These can be illustrated by amounts ranging from about 1% to about 10% and preferably from about 2% to about 5% by weight based on the total surfactant actives weight in the detergent composition.

Low Molecular Weight Carboxylic Acid

In addition to the glycolic acid and salts thereof, a secondary embodiment of this invention includes the addition of a lower molecular weight carboxylic acid, i.e., $C_1$ to $C_4$, in combination with the glycolic acid, desirably the carboxylic acid not being alpha hydroxy substituted. This acid ingredient is used in an amount ranging from about 0.1% to about 5% and preferably from about 0.5% to about 2% by weight based on the total surfactant actives weight in the final detergent composition. Preferred are the water soluble salts. The preferred lower molecular weight carboxylic acid is formic acid or the formate salts, e.g., sodium and potassium.

Calcium

A second beneficial additive which can be used with the glycolic acid alone or in combination with the low lower molecular weight carboxylic acid is enzyme-accessible calcium. The preferred composition contains less than about 4, preferably from about 0.5 to 3 millimoles of enzyme accessible calcium per 100 grams of total surfactant actives weight in the final detergent composition.

The enzyme-accessible calcium is defined as the amount of calcium ions effectively available to the enzyme component. The total calcium incorporated into the composition is comprised of the enzyme-accessible calcium and any calcium sequestered by sequestering agents or builders such as polyacids. From a practical standpoint, the enzyme-accessible calcium is the soluble calcium in the composition in the absence of any strong sequesterants. Any water-soluble calcium salt can be used as a source of the calcium ions including calcium chloride, calcium acetate, calcium formate and calcium propionate. Magnesium ions can replace the calcium ions completely or in part.

pH Adjusting Chemicals

The pH of the final detergent composition should be within a range from about 6.5 to about 11.6. To achieve this pH, pH adjusting chemicals such as acids, bases and buffers can be added to the formulation. Preferred pH adjusting chemicals include lower alkanolamines such as monoethanolamine (MEA) and triethanolaime (TEA). Sodium hydroxide solutions may be utilized as an alkaline pH adjusting agent. These solutions further function to neutralize acidic materials that may be present. Mixtures of more than one pH adjusting chemical can also be utilized.

In practice, the pH adjusting chemicals are used in amounts from about 0 to about 8 weight percent of the final formulation, with amounts ranging from between about 2 to about 8 weight percent being more preferred.

Optional Ingredients

In addition to essential ingredients described hereinbefore, the compositions of the present invention frequently contain a series of optional ingredients which are used for the known functionality in conventional levels.

The compositions of the invention can contain phase regulants as is well known in liquid detergent technology. These can be represented by lower aliphatic alcohols having from 2 to 6 carbon atoms and from 1 to 3 hydroxyl groups, ethers of diethylene glycol and lower aliphatic monoalcohols having from 1 to 4 carbon atoms and the like.

Also included within the composition of the present invention are known detergent hydrotropes. Examples of these hydrotropes include salts of alkylarylsulfonates having up to 3 carbon atoms in the alkyl group e.g., sodium, potassium, ammonium, and ethanolamine salts of xylene, toulene, ethylbenzene, cumene, and isopropylbenzene sulfonic acids.

Other supplemental additives include defoamers such as high molecular weight aliphatic acids, especially saturated fatty acids and soaps derived from them, dyes and perfumes; fluorescent agents or optical brighteners; anti-redeposition agents such as carboxymethyl cellulose and hydroxypropymethyl cellulose; suspension stabilizing agents and soil release promoters such as copolymers of polyethylene terephthalate and polyoxyethylene terephthalate; anti-oxidants; softening agents and anti-static agents; photo activators and preservatives. The preferred composition of the present invention can also include polyacids, suds regulators, opacifiers, anti-oxidants, bacteriacide, and the like. Suds regulants can illustrated by alkylated polysiloxanes and opacifiers can be illustrated by polystyrene; bactericide can be illustrated by butylated hydroxytoulene.

Although not required, an inorganic or organic builder may optionally be added in small amounts to the final composition to provide additional detergency. Examples of inorganic builders include water-soluble alkali metal carbonates, bicarbonates, silicates and crystalline and amorphous alumino silicates. Examples of organic builders include the alkali metal, alkaline metal, ammonium and substituted ammonium polyacetates, carboxylates, polycarboxylates, polyacetyl, carboxylates and polyhydroxy sulfonates. One example of a commonly used builder is sodium citrate.

The liquid laundry detergent formulation of the invention can be produced by any known methods though sequential mixing of the nonionic and anionic surfactants, pH adjusting chemicals, and then the amphoteric surfactants to form the surfactant misture, along with between about 0 and about 5% of the optional additives defined above has been found to be the more preferred method of manufacture. The viscosity of the final formulation is between about 50 and 3000 cps at 25° C. using a Brookfield viscometer, spindle #4 at 20 rpm. A more preferred viscosity is between about 100 and 1000 cps and a most preferred viscosity is between about 100 and 800 cps.

In use, between about ⅛ and 1 cup of the liquid detergent formulation can be added to wash a standard load of laundry (about 17 gallons of water in U.S.), the amount being dependant on the surfactant concentration in the formulation. In preferred use, the amount of laundry detergent added per wash load is between about ⅛ and about ¼ cups. The detergent formulations are designed for use in cold, warm and hot temperature wash cycles and are effective for wash temperatures ranging from about 5° C. and about 60° C., with a preferred wash temperature ranging from about 15° C. to about 45° C.

The invention is described in greater detail in connection with the following non limiting examples.

EXAMPLES 1–9

A series of experiments was conducted to determine the stabilizing effect of glycolic acid in stabilizing a protease enzyme with varying levels of sodium formate. The calcium ion concentration was maintained constant. The activity of the enzyme was determined after 2 and 4 week periods at storage temperatures of 22° C. and 37° C.

In order to determine the proteolytic activity of a protease enzyme, alkaline protease was allowed to hydrolyze a known amount of azocasein for 30 minutes at 40° C. Undigested protein was precipitated with trichloroacetic acid and the quantity of digested product was determined by spectrophotometry (at 390 nm.)

The azocasein substrate solution was prepared by dissolving with agitation 0.6 grams of azocasein in 10 ml. of a 50% urea/water solution, adding 10 ml. of a 2.0M.Tris buffer solution (2.0M. trishydroxymethylaminomethane in distilled water, pH 8.5 adjusted with $H_2SO_4$-Tris buffer solution) and 30–50 ml. of deionized water. Stirring was continued until clear; the pH was adjusted to 8.5 using $H_2SO_4$ and the volume was adjusted to 100 ml. with distilled water.

To labeled test tubes containing 1 ml. of pipetted sample or enzyme standard, equilibrated to 40° C., at precisely timed intervals was added 5 ml. azocasein substrate solution to each tube containing sample or standard, the tubes were agitated and heated in a 40° C. waterbath for 30 minutes.

Simultaneously, to a sample blank was added 5 ml. of a 10% tricholoracetic acid solution. After adding 5 ml. of azocasein substrate solution, the blank was agitated and allowed stand at room temperature until ready to filter.

After exactly 30 minutes, at the same time intervals as before, 5 ml. of 10% by weight trichloroacetic acid solution was added to each sample or standard tube, agitated and allowed to stand at room temperature.

After 15–20 minutes, all tubes were filtered by gravity filtration through Whatman 3 filers in clean, dry and labeled test tubes. The absorbencies were read at 390 nm. versus a deionized water blank.

A standard curve was prepared using an enzyme of known activity . A stock solution containing an amount of enzyme standard dissolved in 100 ml of a 0.2M Tris buffer solution at pH 8.5 sufficient to provide $1\times10^{-2}$ KNPU/ml was prepared and diluted to provide solutions of varying concentrations of enzyme. A standard blank having an $S_o$ of less than 0.16 was subtracted from the $A_{390}$ to obtain the Δ absorbance. A curve of Δ absorbence v. proteolytic activity was plotted. A NPU or Novo Protease Unit is the amount of proteolytic enzyme which under standard incubation conditions hydrolyzes casein at such a rate that the initial rate of formation of peptides/minute corresponds to 1 micromole of glycine/minute (KNPU equal 1,000 NPU).

Using the standard curve, the activity of sample/tube was determined.

The following formulations were tested and contained (unless otherwise noted) the following (weight % basis of total formulation):

TABLE I

| | |
|---|---|
| 25.02 | Alkylether Sulfate |
| 4 | Monoethanolamine |
| 4 | Triethanolamine |
| 30 | Nonylphenol Ethoxylate (9 EO) |
| 26.8 | Sodium Cocoamphoacetate |
| 00.5 | Preservative (Na Nitrate) |
| 1.63 | CaCl Solution (1% Ca solution) |
| 2 | Protease Enzyme |
| Remainder | Water |

(The protease enzyme as used herein is 16.0 L. Savinase)

The following results were obtained:

TABLE II

| | | | % Loss of Enzyme Activity | | | |
|---|---|---|---|---|---|---|
| | | | 22° C. | | 37° C. | |
| Example No. | Glycolic Acid | Sodium Formate | 2 Weeks | 4 Weeks | 2 Weeks | 4 Weeks |
| 1. | 0.5 | 3.0 | 10 | 23 | 74 | 91 |
| 2. | 0.5 | 3.0 | 7 | 21 | 75 | 91 |
| 3. | 1.375 | 2.5 | 0 | 10 | 52 | 77 |
| 4. | 1.5 | 2.0 | 8 | 18 | 57 | 80 |
| 5. | 2.25 | 2.0 | 3 | 9 | 39 | 67 |
| 6. | 2.5 | 1.0 | 5 | 12 | 48 | 73 |
| 7. | 3.0 | 1.0 | 0 | 1 | 41 | 64 |
| 8. * | 3.0 | 1.8 | 8 | 8 | 18 | 39 |
| 9.** | — | 1.8 | 60 | 60 | 82 | 94 |

* 24.72 Alkyl Ether Sulfate
** 24.72 Alkyl Ether Sulfate
33.0 Nonylphenol

The above data shows that glycolic acid is highly effective in stabilizing a liquid heavy duty laundry detergent as compared to the control (Example 9) which showed at least 60% enzyme activity loss even at room temperature.

EXAMPLES 10 to 13

The stabilizing effect of glycolic acid was evaluated against two separate surfactants. The formulations that were tested contained the following (weight % basis of total formulation):

TABLE III

| | |
|---|---|
| 24.5 | Alkylether Sulfate |
| (21.5) | (if glycolic acid is present) |
| 4.0 | Monoethanolamine |
| 4.0 | Triethanolamine |
| 20.0 | Nonylphenol Ethoxylate (9 EO) |
| 2.0 | Proteolytic Enzyme |

The following results were obtained:

TABLE IV

| | | | | % Loss of Enzyme Activity | | | |
|---|---|---|---|---|---|---|---|
| | | | | 22° C. | | 37° C. | |
| Example | Surfactant | | Glycolic | 2 | 4 | 2 | 4 |
| No. | FBS* | CB** | Acid | Weeks | Weeks | Weeks | Weeks |
| 10. | 45.5 | — | — | 16 | 31 | 74 | 85 |
| 11. | 45.5 | — | 3.0 | 8 | 8 | 49 | 75 |
| 12. | — | 45.5 | — | 74 | 85 | 95 | 98 |
| 13. | — | 45.5 | 3.0 | 15 | 22 | 53 | 75 |

*Disodium Cocoampho Dipropionate
**Coco Dimethyl Betaine

As can be seen by the data, while the amphoteric containing formulation had good stability at 22° C., the use of the glycolic acid enzyme stabilizer of the invention improved stability, with a significant prevention of loss after 4 weeks. At 37° C., significant reductions were also shown. In the case of the betaine, the enzyme system was substantially inactivated at 22° C. in the absence of the glycolic acid but was still effective even after 4 weeks at 22° C. and 37° C.

EXAMPLES 14 to 16

The effect of two different amounts of glycolic acid was compared to a control using an amphoteric surfactant. These were compared to a similar formulation without amphoteric surfactant and glycolic acid using an alkyl ether sulfate. In addition to the ingredients noted in TABLE V, the formulations contained 4 grams each of mono and tri-ethanol amine, 20 grams of nonylphenol ethoxylate (9 EO) and 2 grams enzyme. The results support the conclusion that increased amounts of glycolic acid provide increased enzyme stability.

TABLE V

| | | | | % Loss of Enzyme Activity | | | |
|---|---|---|---|---|---|---|---|
| | | | | 22° C. | | 37° C. | |
| Example | Surfactant | | Glycolic | 2 | 4 | 2 | 4 |
| No. | NA-61* | C-37** | Acid | Wks. | Wks. | Wks. | Wks. |
| 14. | 24.5 | 45.5 | — | 70 | 82 | 98 | |
| 15. | 23.5 | 45.5 | 1.0 | 10 | 25 | 87 | 100 |
| 16. | 21.5 | 45.5 | 3.0 | 0 | 12 | 68 | 77 |

TABLE V-continued

| Example No. | Surfactant NA-61* | Surfactant C-37** | Glycolic Acid | % Loss of Enzyme Activity 22° C. 2 Wks. | 22° C. 4 Wks. | 37° C. 2 Wks. | 37° C. 4 Wks. |
|---|---|---|---|---|---|---|---|

*Alkyl Ether Sulfate
**Sodium Cocoampho Acetate

EXAMPLES 17 & 18

The following examples show the effect of the stabilizing system of the invention on an alkyl ether sulfate which is harsh on enzymes. In addition to the ingredients noted in TABLE VI, the formulations included 4 grams each of mono and tri-ethanol amine and 2 grams enzyme. The results show the glycolic acid of the invention to be extremely effective in enzyme stabilizing.

TABLE VI

| Example No. | Surfactant NA-61*** | Surfactant C-37** | Surfactant CO-630* | Glycolic Acid | % Loss of Enzyme Activity 22° C. 2 Wks. | 22° C. 4 Wks. | 37° C. 2 Wks. | 37° C. 4 Wks. |
|---|---|---|---|---|---|---|---|---|
| 17. | 27.88 | 26.8 | 30.32 | 5.0 | 2 | 2 | 16 | 42 |
| 18. | 29.88 | 26.7 | 33.32 | — | — | — | 100 | — |

*Nonylphenol Ethoxylate (9 EO)
**Sodium Cocoampho Acetate
***Alkyl Ether Sulfate The results of Examples 17 and 18 show that the use of glycolic acid significantly improves the stability of enzymes.

What is claimed is:

1. A stabilized enzyme system in a liquid detergent formulation consisting of an effective cleaning amount of an enzyme and glycolic acid or its salts thereof in an amount sufficient to stabilize said enzyme.

2. A stabilized enzyme system in a liquid detergent formulation consisting of an effective cleaning amount of an enzyme, glycolic acid or its salts thereof in an amount sufficient to stabilize said enzyme and an enzyme accessible alkaline earth metal ion.

3. The enzyme system of claim 2 wherein said alkaline earth metal ion is calcium.

4. A stabilized enzyme system in a liquid detergent formulation consisting of an effective cleaning amount of an enzyme, glycolic acid or its salts thereof, in an amount sufficient to stabilize said enzyme, an enzyme accessible alkaline earth metal ion and a lower alkyl carboxylic acid or salt thereof.

5. The stabilized enzyme system of claim 4 wherein said alkaline earth metal ion is calcium.

6. The stabilized enzyme system of claim 5 wherein said lower alkyl carboxylic acid is formic acid or its salts.

7. A liquid laundry detergent composition containing a stabilizing system for an enzyme consisting of:

(a) from about 5% to about 85% of a surfactant, the active weight based on the total weight of the detergent composition;

(b) from about 0.1% to about 5.0% of an enzyme based on 100% activity; and, as a stabilizer system therefore, (c) a stabilizingly effective amount of glycolic acid or salt thereof;

(d) optionally a detergent additive ingredient selected from the group consisting of carboxylic acid or salts thereof with the proviso that the carboxylic acid is not glycolic acid or salts thereof, an enzyme accessible alkaline earth metal ion, or mixtures thereof.

8. The liquid laundry detergent composition as recited in claim 7, wherein said enzyme Is selected from the group consisting of proteases, amylases, cellulases, oxidases and mixtures thereof.

9. The liquid laundry detergent composition as recited in claim 8, wherein said enzyme is selected from the group consisting of proteases and mixtures thereof.

10. The liquid laundry detergent composition as recited in claim 7, wherein said carboxylic acid salt is sodium formate.

11. The liquid laundry detergent composition as recited in claim 7, wherein said alkaline earth metal ion is calcium Ion.

12. The liquid laundry detergent composition as recited in claim 11, wherein the glycolic acid and salts thereof are present at a level of from about 1% to about 10% by weight based on the total surfactant actives weight in the detergent composition.

13. The liquid laundry detergent composition as recited in claim 12, wherein said surfactant comprises from about 1% to about 35% by weight of an amphoteric or zwitterionic surfactant based on the total surfactant actives weight in the detergent composition.

14. The liquid detergent composition as recited in claim 13, wherein said surfactant comprises from about 1% to about 50% by weight of an anionic surfactant based on the total surfactant actives weight in the detergent composition.

15. The liquid laundry detergent composition as recited in claim 14, wherein said surfactant contains about 1% to about 75% by weight of a nonionic surfactant based on the total surfactant actives weight in the detergent composition.

16. A heavy duty liquid laundry detergent composition containing a stabilizing system for a proteolytic enzyme consisting of:

(a) A mixture of surfactants consisting of:

(i) between about 1% and about 35% by weight of one or more amphoteric or zwitterionic surfactants:

(ii) between about 1% and about 50% by weight of one or more anionic surfactants;

(iii) between about 1% and about 75% by Weight of one or more nonionic surfactants, said percentages being by weight based on the total surfactant actives weight in the detergent composition, the sum of (i), (ii), and (iii) being between about 5.0% and about 85% surfactant actives weight based on the total weight of the detergent composition;

(b) from about 0.01% to about 5.0% enzyme based on a 100% activity level, and;

(c) an enzyme stabilizingly effective amount of glycolic acid or the salt thereof;

(d) optionally a detergent additive ingredient selected from the group consisting of carboxylic acid or salts thereof with the proviso that the carboxylic acid is not glycolic acid or salts thereof, an enzyme accessible alkaline earth metal ion, or mixtures thereof.

17. The liquid laundry detergent composition as recited in claim 16, wherein said enzyme is selected from the group consisting of proteases and mixtures thereof.

18. The liquid laundry detergent composition as recited in claim 16, wherein said carboxylic acid salt is sodium formate.

19. The liquid laundry detergent composition as recited in claim 18, wherein said amphoteric surfactant is selected from the group consisting of the alkali metal, alkaline earth metal, ammonium or substituted ammonium salts of alkylamphocarboxy-glycinates, alkylamphocarboxy-proplonates, alkylampho-dipropionates, alkylampho-monoacetates, alkylampho-diacetates, alkylampho-glycinates and alkylampho-propionates wherein the alkyl represents an alkyl group having from about 6 to about 20 carbon atoms, alkylaminopropionates, alkylimino-diproplonates and alkyl amphopropyl sulfonates having between about 12 and about 18 carbon atoms, and alkyl betaines, amidopropyl betaines, alkyl sultaines and alkylamidopropyl hydroxy suitaines wherein alkyl represents an alkyl group having from about 6 to about 20 carbon atoms and mixtures thereof.

20. The liquid laundry detergent composition as recited in claim 19, wherein alkyl represents a lauryl or coco-group.

21. The liquid laundry detergent composition as recited in claim 20, wherein said surfactant comprises from about 5% to about 30% by weight of an amphoteric or zwitterionic surfactant based on the total surfactant actives weight in the detergent composition.

22. The liquid laundry detergent composition as recited in claim 21, wherein said anionic surfactant is selected from the group consisting of the water soluble salts of alkyl benzene sulfonates having between about 8 and about 22 carbon atoms in the alkyl group, alkyl ether sulfates having between about 8 and about 22 carbon atoms In the alkyl group, and alkali metal, ammonium and alkanolammonium salts of organic sulfuric reaction products having in their molecular structure an alkyl or aralkyl group containing from about 8 to about 22 carbon atoms and a sulfonic or sulfuric acid ester group and mixtures thereof.

23. The liquid laundry detergent composition as recited in claim 22, wherein said anionic surfactant is selected from the group consisting of linear sodium and potassium alkyl ether sulfates that are synthesized by sulfating a higher alcohol having between about 8 and about 22 carbon atoms and having from about 2 to about 9 moles of ethylene oxide and alkyl benzene sulfonates in which the alkyl group contains between about 9 and about 15 carbon atoms, and mixtures thereof.

24. The liquid laundry detergent composition as recited in claim 23, wherein said surfactant mixture comprises from about 5% to about 40% by weight anionic surfactant on an actives basis based on the total surfactant actives weight in the detergent composition.

25. The liquid laundry detergent composition as recited in claim 24, wherein said nonionic surfactant is selected from the group consisting of condensation products or primary aliphatic alcohols having from about 8 to about 24 carbon atoms, in either straight or branch chain configuration, with from about 2 to about 40 moles of ethylene oxide per mole of alcohol and condensation products of from about 6 to about 12 carbon atoms, alkyl phenols with from about 3 to about 30 moles of ethylene oxide and mixtures thereof.

26. The liquid laundry detergent composition as recited in claim 25, wherein said surfactant mixture contains about 6% to about 50% by weight of a nonionic surfactant on an actives basis based on the total surfactant actives weight in the detergent composition.

27. The liquid laundry detergent composition as recited in claim 16, wherein the viscosity of said composition Is between about 50 and 1,000 cps at 25° C. using a Brookfield viscometer, spindle #4 at 20 rpm.

28. The process for washing one load of clothes in water at wash temperatures between about 5° C. and about 60° C. comprising the step of adding to the wash water an amount of the composition of claim 14 sufficient to clean the clothes in the wash.

* * * * *